US011889876B1

(12) United States Patent
Blaylock

(10) Patent No.: US 11,889,876 B1
(45) **Date of Patent: *Feb. 6, 2024**

(54) SECRETIVE MULTIPURPOSE CARRYING SYSTEM

(71) Applicant: Brenda Blaylock, Decatur, TX (US)

(72) Inventor: Brenda Blaylock, Decatur, TX (US)

( * ) Notice: Subject to any disclaimer, the term of this patent is extended or adjusted under 35 U.S.C. 154(b) by 54 days.

This patent is subject to a terminal disclaimer.

(21) Appl. No.: 17/167,361

(22) Filed: Feb. 4, 2021

Related U.S. Application Data

(63) Continuation-in-part of application No. 15/430,421, filed on Feb. 10, 2017, now Pat. No. 10,912,343.

(60) Provisional application No. 62/293,577, filed on Feb. 10, 2016.

(51) Int. Cl.
*A41D 27/20* (2006.01)
*A45C 13/02* (2006.01)
*A45C 3/06* (2006.01)

(52) U.S. Cl.
CPC ..... *A41D 27/205* (2013.01); *A45C 3/06* (2013.01); *A45C 13/02* (2013.01)

(58) Field of Classification Search
CPC ..... A41D 27/205
USPC ..... 2/91
See application file for complete search history.

(56) References Cited

U.S. PATENT DOCUMENTS 8,468,612 B1 * 6/2013 Galloway ..... A41D 27/20 2/207
9,138,022 B2 * 9/2015 Walker ..... A41D 27/205
2005/0125878 A1 * 6/2005 Bjelland ..... G09F 21/02 2/207

* cited by examiner

*Primary Examiner* — Timothy K Trieu
(74) *Attorney, Agent, or Firm* — Richard Eldredge

(57) ABSTRACT

A secretive multipurpose carrying system includes an article with a front surface and a back surface; a pouch integral with article and accessible from the back surface; and gathers created by the front surface of the article, the gathers created by excess fabric and running adjacent to one another such that the presence of the pouch as well as effects stored in the pouch are concealed from view.

1 Claim, 6 Drawing Sheets

SECRETIVE MULTIPURPOSE CARRYING SYSTEM

BACKGROUND

1. Field of the Invention

The present invention relates generally to carrying systems, and more specifically, to an integrated carrying system where the carrying system is embedded within an article of clothing.

2. Description of Related Art

Integrated carrying systems are well known in the art and are effective means to incorporate a purse into an article of clothing. For example, FIGS. 1A and 1B depict a conventional integrated carrying system 101 having a sash 103 with a closable pouch 105 integral to the body 115 of the sash 103. During use, personal effects 107, 109, 111 are placed in the closeable pouch 105 within the sash 103 which is worn by a person 113.

One of the problems commonly associated with system 101 is theft of the personal effects. For example, a thief can easily determine that there are potentially valuable items in the integrated carrying system 101 making the person 113 a target for theft.

Accordingly, although great strides have been made in the area of integrated carrying systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
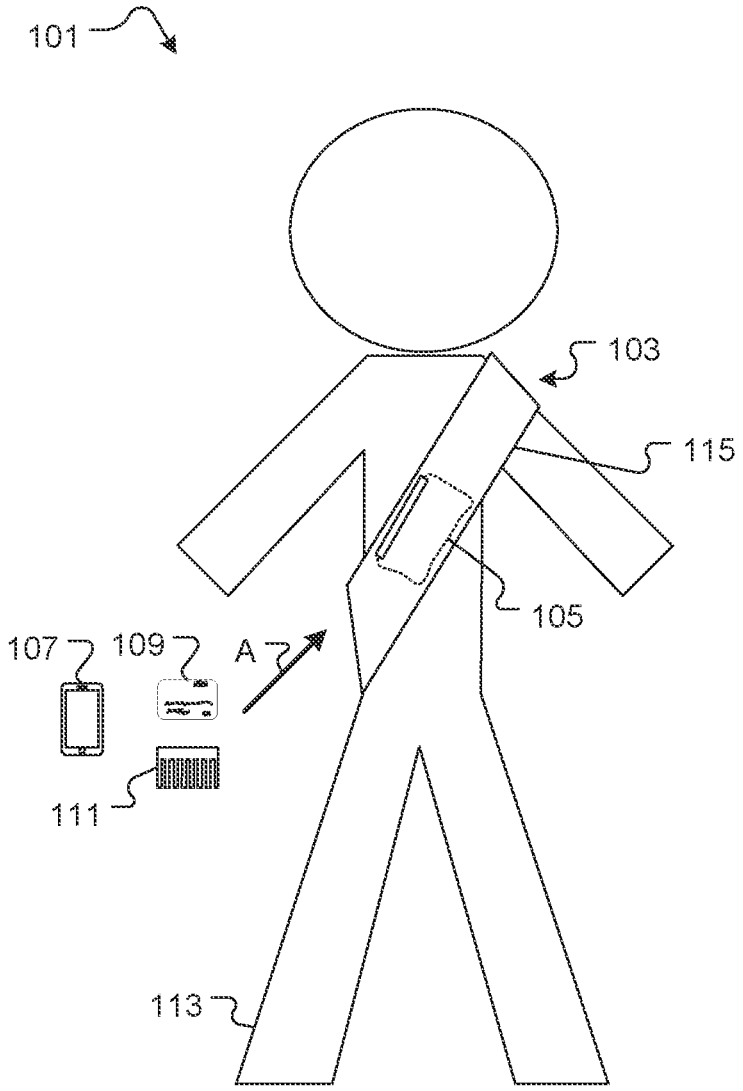
FIG. 1A (Prior Art)
FIGS. 1A and 1B are front views of a common integrated carrying system.
Figure 1B:
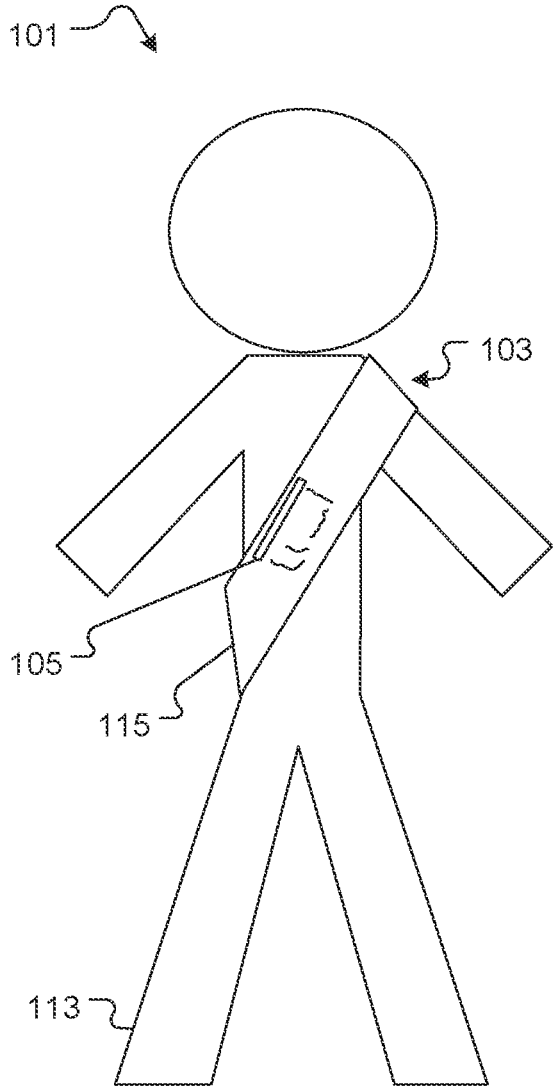
FIG. 1B (Prior Art)

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional multipurpose carrying systems. Specifically, the system of the present application conceals a storage compartment within a garment minimizing the risk of identifying the presence of personal effects and the theft of them. This and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
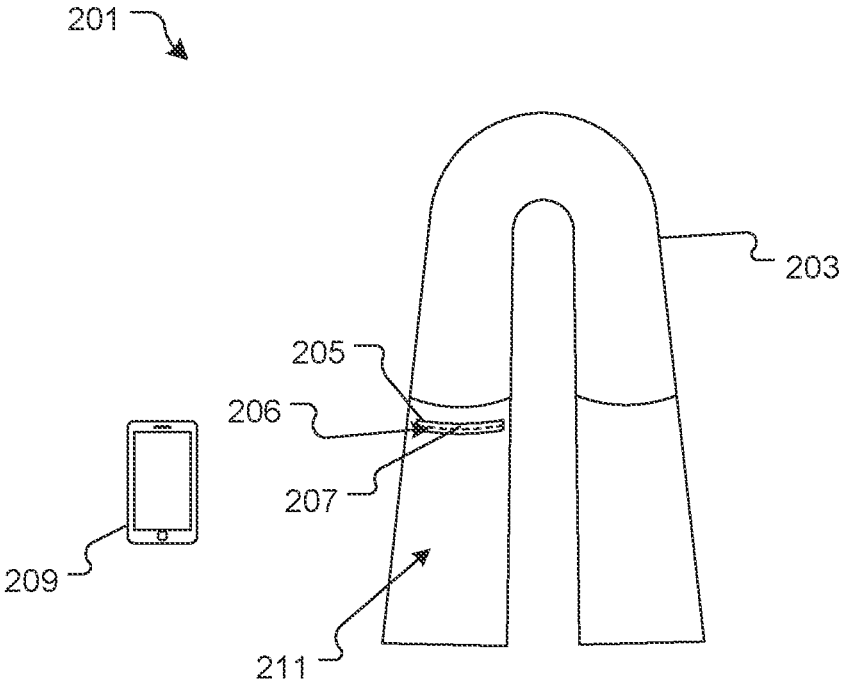
FIG. 2 is a back view of a secretive multipurpose carrying system in accordance with a preferred embodiment of the present application.
Figure 3:
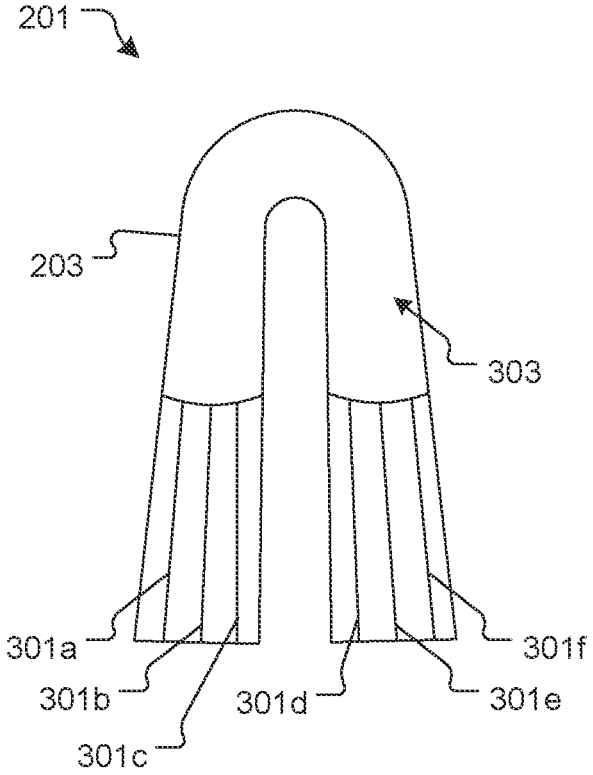
FIG. 3 is a front view of the system of FIG. 2.

Referring now to the drawings wherein like reference characters identify corresponding or similar elements throughout the several views, FIGS. 2 and 3 depict a rear and front view respectively of a secretive multipurpose carrying system 201 in accordance with a preferred embodiment of the present application. It will be appreciated that system 201 overcomes one of more of the above-listed problems commonly associated with conventional integrated carrying systems.

In the contemplated embodiment, system 201 includes a garment 203 depicted as a scarf with an integrated pouch 205 for carrying personal effects 209. In the current embodiment the pouch is accessible from the back surface 211 of the garment 203 via an opening 206 which may include a closure 207. It should be appreciated that the closure 207 may be a zipper, buttons, hook and loop fastener, or the like. The garment 203 also having a plurality of gathers 301 built into the front surface 303 of the garment in front of the integrated pouch 205 and configured to conceal the presence of both the pouch 205 and any effects 209 stored in the pouch 205. It should be appreciated that in the preferred embodiment, the gathers are created by an excess of material built into the front surface, the excess of material making the presence of the pouch unnoticeable from the front.

Figure 4A:
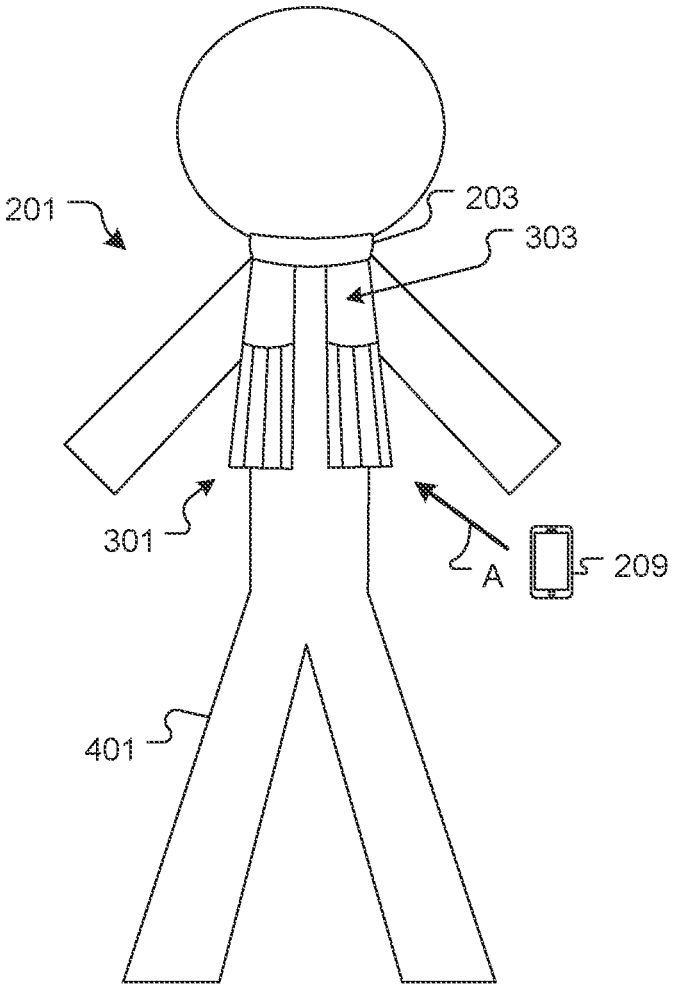
FIGS. 4A and 4B are front views of the system of FIGS. 2 and 3 in use.
Figure 4B:
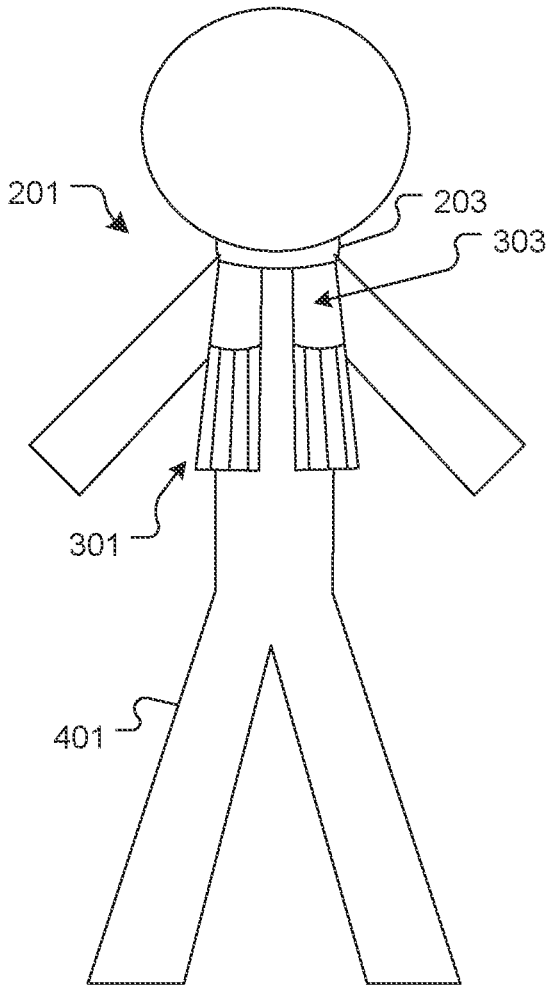

Referring now to FIGS. 4A and 4B the system 201 is depicted in use. Personal effects 209 are hidden as depicted by motion A within the pouch 205 behind gathers 301 of garment 203 such that the effects 209 are hidden from view when garment 203 is carried by the person 401.

It should be appreciated that one of the unique features believed characteristic of the present application is that the gathers 301 of garment 203 conceal the existence of the closable pouch 205. The gathers 301 disrupt the natural flow of the garment 203 front surface 303. These disruptions disguise the presence of the closeable pouch 205. It is understood that by concealing closeable pouch 205 in this manner a potential thief is less likely to identify the personal effects 209 or the person 401 as targets.

Figure 5:
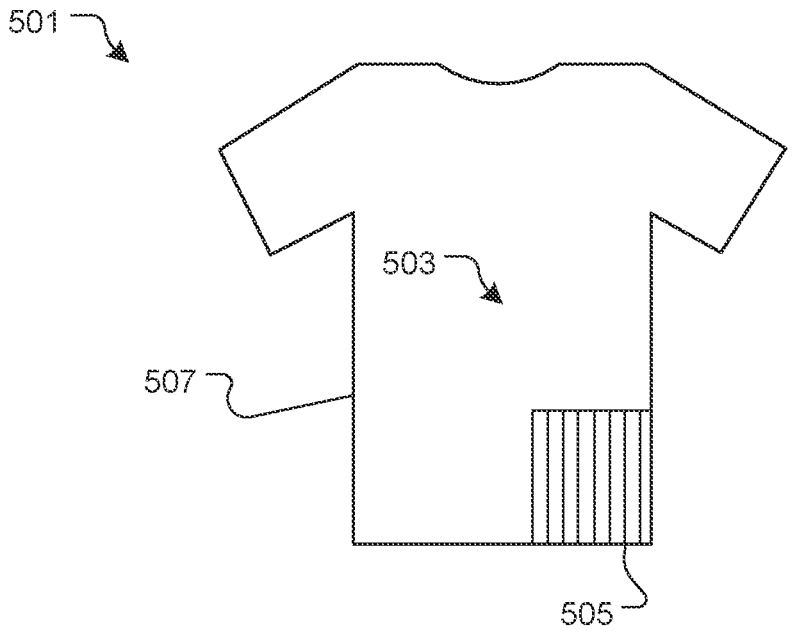
FIG. 5 is a simplified front view of an alternative embodiment of a secretive multipurpose carrying system in accordance with the application.

It should be appreciated that the concealable pouch can be built into any garment, including a scarf and other garments wherein there is material on the front that can be collected into the plurality of gathers. This is demonstrated in FIGS. 5 and 6 for examples. In FIG. 5, an example of a shirt 501 as the garment is shown, wherein the concealable pouch 503 is behind the plurality of gathers 505 built into the front surface 507 of the garment. It should be appreciated that the pouch 503 here is shown in one section of the shirt, but the pouch could be moved to any location and made larger or smaller as aesthetical or functional considerations require.

Figure 6:
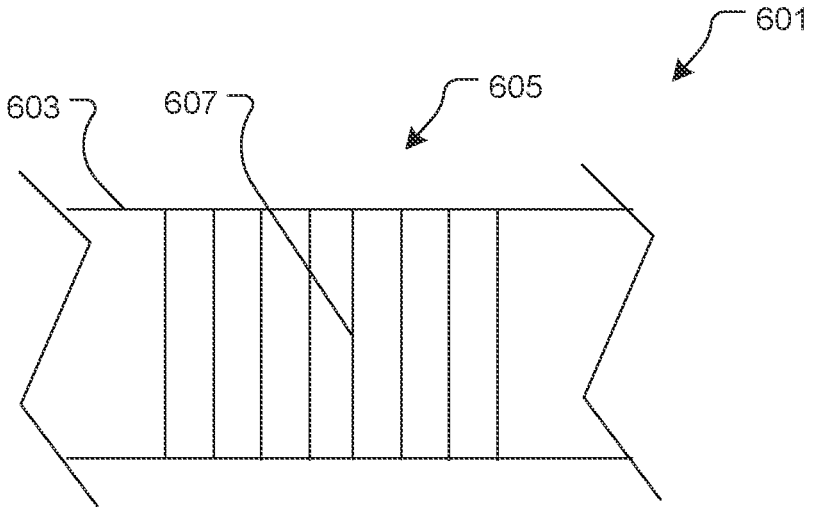
FIG. 6 is a front view of another alternative embodiment of a secretive multipurpose carrying system in accordance with the present application.

In FIG. 6, a portion 603 of any article 601 is shown. It should be appreciated that the article may be clothing, a handbag, or any other article in which material is used. As shown, the pouch 605 is positioned behind a plurality of gathers 607. Again, this should be understood that the present invention is not limited to any particular garment or article.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A secretive multipurpose carrying system comprising:

a scarf extending from a first end to a second end and with a front surface and a back surface;

a pouch positioned between the front surface and the back surface of the scarf and accessible from the back surface;

a closure configured to close the pouch, the closure is a zipper;

and a plurality of gathers created by the front surface of the article and positioned on both the first end that the second end, the plurality of gathers created by excess fabric and running adjacent to one another.

* * * * *